US006230427B1

(12) United States Patent
McDaniel

(10) Patent No.: US 6,230,427 B1
(45) Date of Patent: May 15, 2001

(54) BILLBOARD WITH DROPPINGS TRAY

(76) Inventor: Timothy D. McDaniel, 10807 Montevista, Montclair, CA (US) 91763

( * ) Notice: Subject to any disclaimer, the term of this patent is extended or adjusted under 35 U.S.C. 154(b) by 0 days.

(21) Appl. No.: 09/337,143

(22) Filed: Jun. 21, 1999

(51) Int. Cl.[7] ..... G09F 15/00
(52) U.S. Cl. ..... 40/624
(58) Field of Search ..... 40/624

(56) References Cited

U.S. PATENT DOCUMENTS 3,010,234 * 11/1961 Hopkins ..... 40/624
3,071,871 * 1/1963 Ramseur, Jr. ..... 40/624
4,133,123 * 1/1979 Anderson ..... 40/611 X
4,254,569 * 3/1981 Janik ..... 40/606
4,492,049 * 1/1985 Gaylor ..... 40/624
6,044,595 * 4/2000 Snow ..... 52/101

FOREIGN PATENT DOCUMENTS

2678413 * 12/1992 (FR) ..... 40/624

* cited by examiner

*Primary Examiner*—Brian K. Green
*Assistant Examiner*—Andrea Chop
(74) *Attorney, Agent, or Firm*—Harry G. Weissenberger, Esq.

(57) ABSTRACT

A billboard is equipped with a droppings tray that catches droppings from birds nesting in the gridwork of support members that carries the display panels of the billboard. The tray is so inclined and shaped that rain or the like cleans the tray and flushes the droppings into a drainpipe.

9 Claims, 5 Drawing Sheets

BILLBOARD WITH DROPPINGS TRAY

FIELD OF THE INVENTION

This invention relates to outdoor billboards, and more particularly to a billboard with a tray adapted to catch droppings of birds nesting on the billboard.

BACKGROUND OF THE INVENTION

Because of their height above ground and the gridwork of support members that carry the display panels, outdoor advertising billboards or signs are a favorite nesting site for birds. Such billboards are sometimes erected in places, such as a parking lot, where human activity takes place underneath the billboard. In those cases, a problem arises from the fact that droppings from the birds nesting on the billboard soil the ground, and objects, such as cars, under the billboard.

Various methods have been used in the past to deter birds from nesting on billboards. These include studding the billboard with sharp spikes such as nails, or placing onto the top surface some propeller-like devices which turn in the wind and scare the birds. Unfortunately, none of these methods have been fully successful, and the droppings problem still persists.

SUMMARY OF THE INVENTION

The present invention solves the above-described problem by accepting the presence of birds, but preventing their droppings from affecting human activities under the billboard by providing a droppings tray on the underside of the billboard. The inventive droppings tray is so shaped that it catches droppings from above and provides a way to clean the captured droppings away either naturally by rain or purposely by a water spray. The droppings tray of this invention is so positioned and dimensioned that it does not interfere with the legibility of the billboard's message, detract from the aesthetics of the board itself, nor impede its maintenance.

DESCRIPTION OF THE PREFERRED EMBODIMENTS

FIGS. 1–4 illustrate a double-sided billboard 10 constructed according to the invention.

Figure 1:
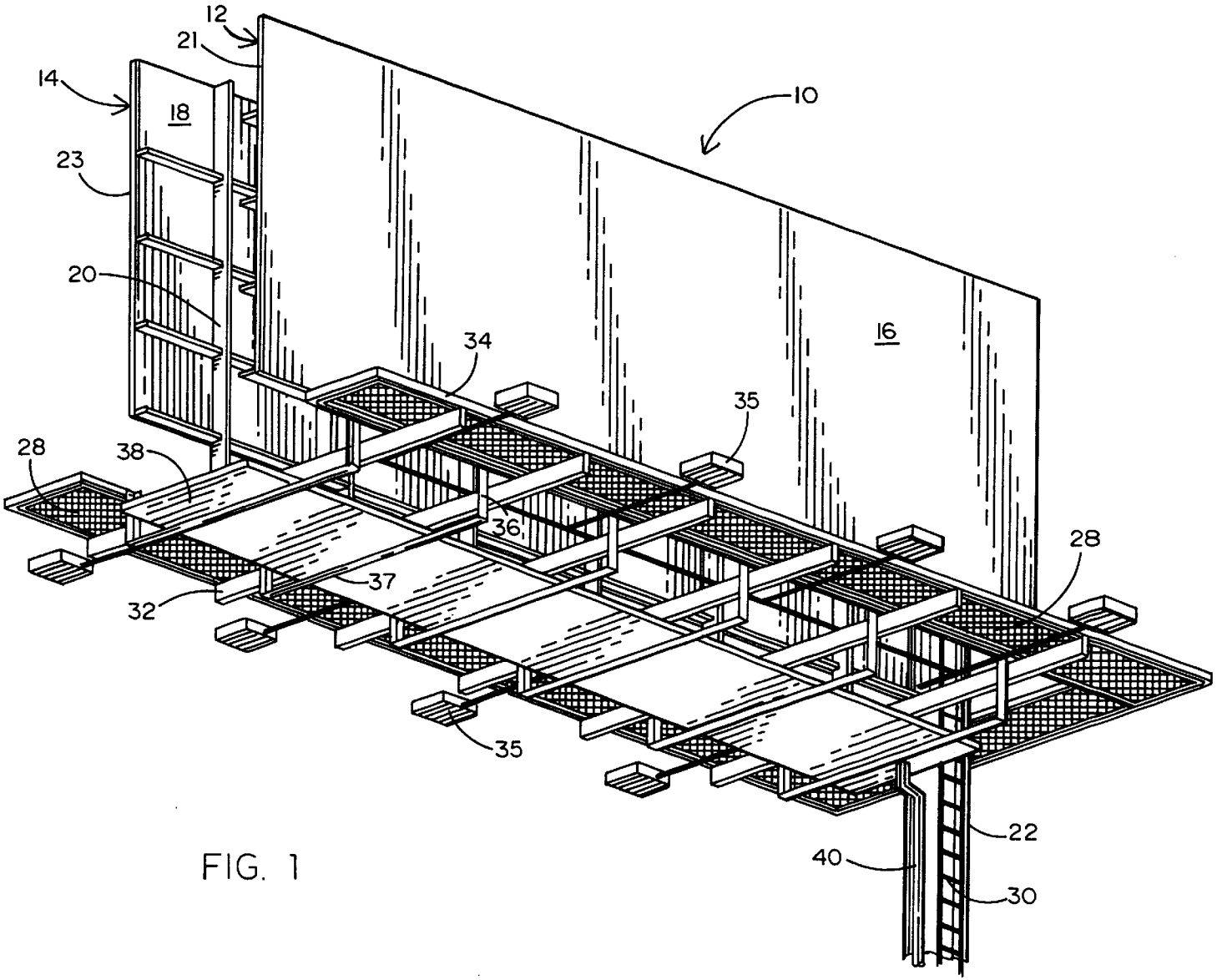
FIG. 1 is a perspective view of a billboard using the invention.
Figure 2:
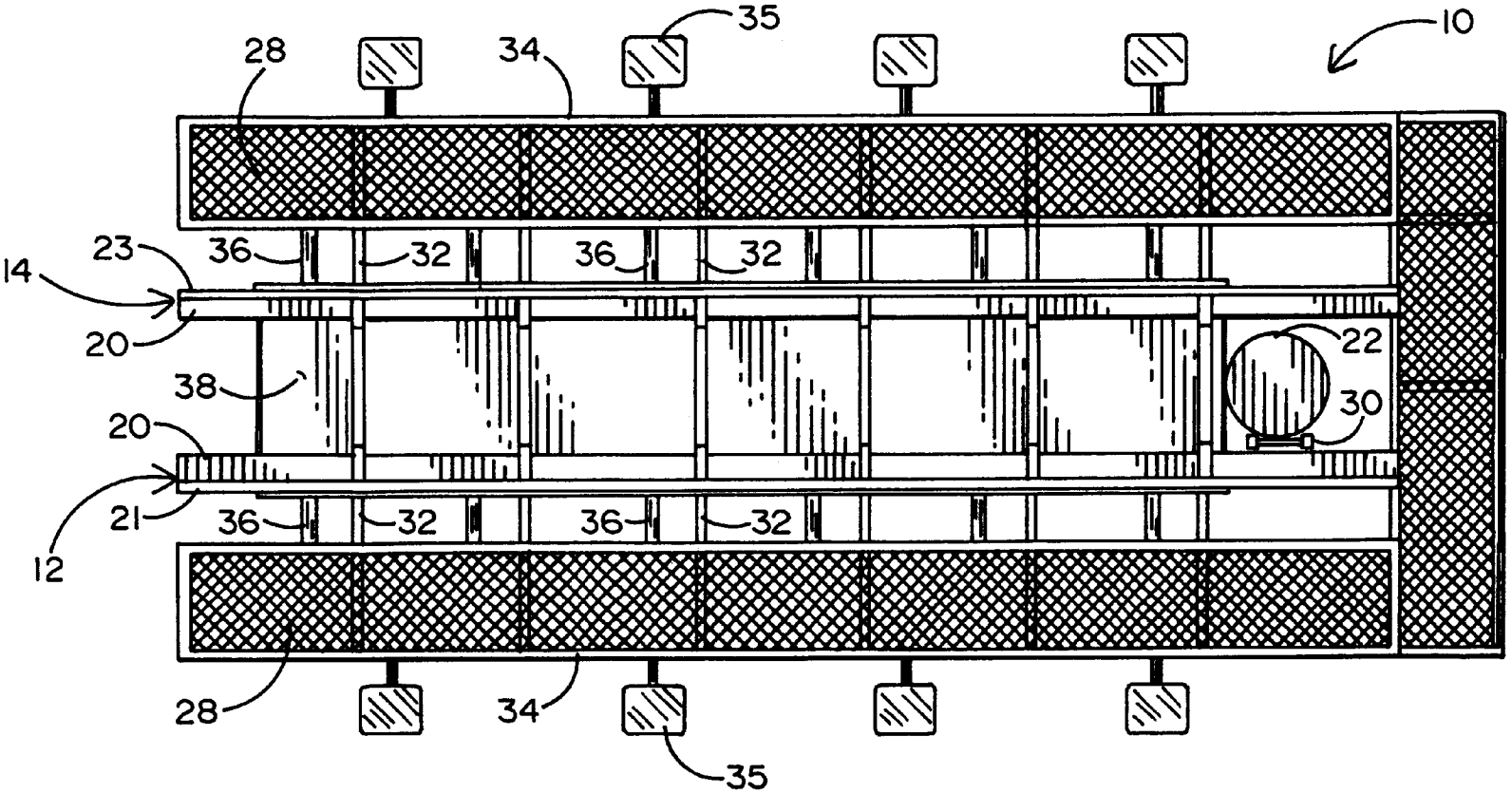
FIG. 2 is a plan view of the billboard of FIG. 1.

In these figures, the billboard 10 is composed of a pair of parallel display panel assemblies 12, 14, each of which has an outwardly facing front side or sign face 16 and an inwardly facing rear face 18. Each rear face 18 is formed by a wood or steel grid 20 which supports the display panels 21, 23, and which is in turn mounted on a support column 22. The column 22 may be positioned at the center of the grids 20 or at one lateral end thereof as shown in FIG. 1. The openings between the horizontal and vertical members of the grid 20, coupled with the relatively close spacing between the display panel assemblies 12, 14, form attractive nesting sites for birds. The nests 25 (see FIG. 5) typically protrude into the open space 24 (see FIG. 4) between the grids 20, and the nesting birds tend to drop debris and waste 27 into that space. A further nesting opportunity in the space 24 may be provided by the apertured walkway or deck 26 (typically a rigid steel mesh) which runs between the grids 20 and is seldom used.

In order to allow servicing of the display panels 21, 23, a front deck 28 is provided in front of and below each sign face 16. The front deck 28, like the rear deck 26, may be formed of a rigid steel mesh, and may be accessible by a ladder 30 (FIG. 1). The apertured deck 28 is vertically spaced from the bottom edge of the panel assembly 12 or 14, both in order to avoid obscuring a portion of the panel 21 or 23 from an observer on the ground, and in order to allow convenient servicing access to all of the panel 21 or 23.

Figure 3:
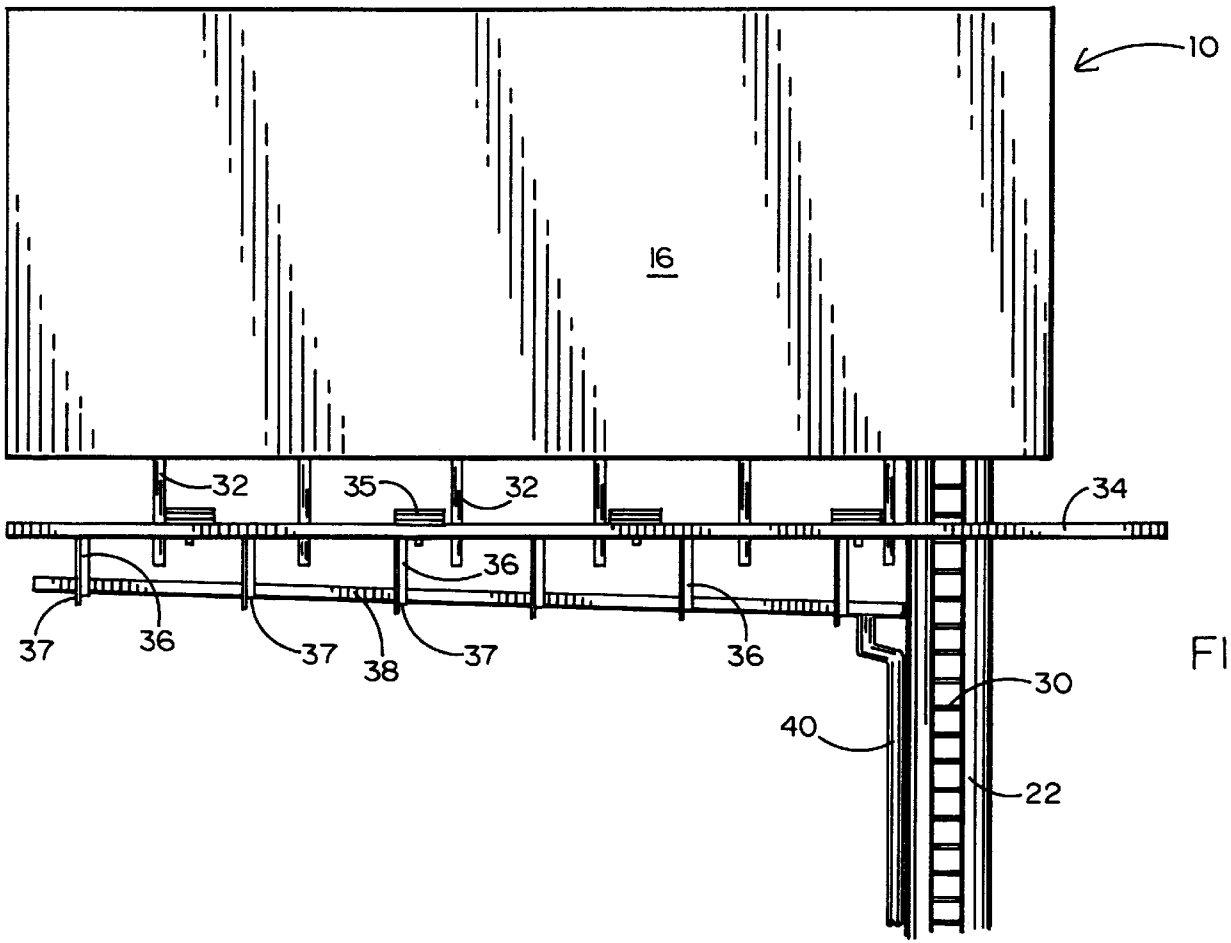
FIG. 3 is a front elevation of the billboard of FIG. 1.
Figure 4:
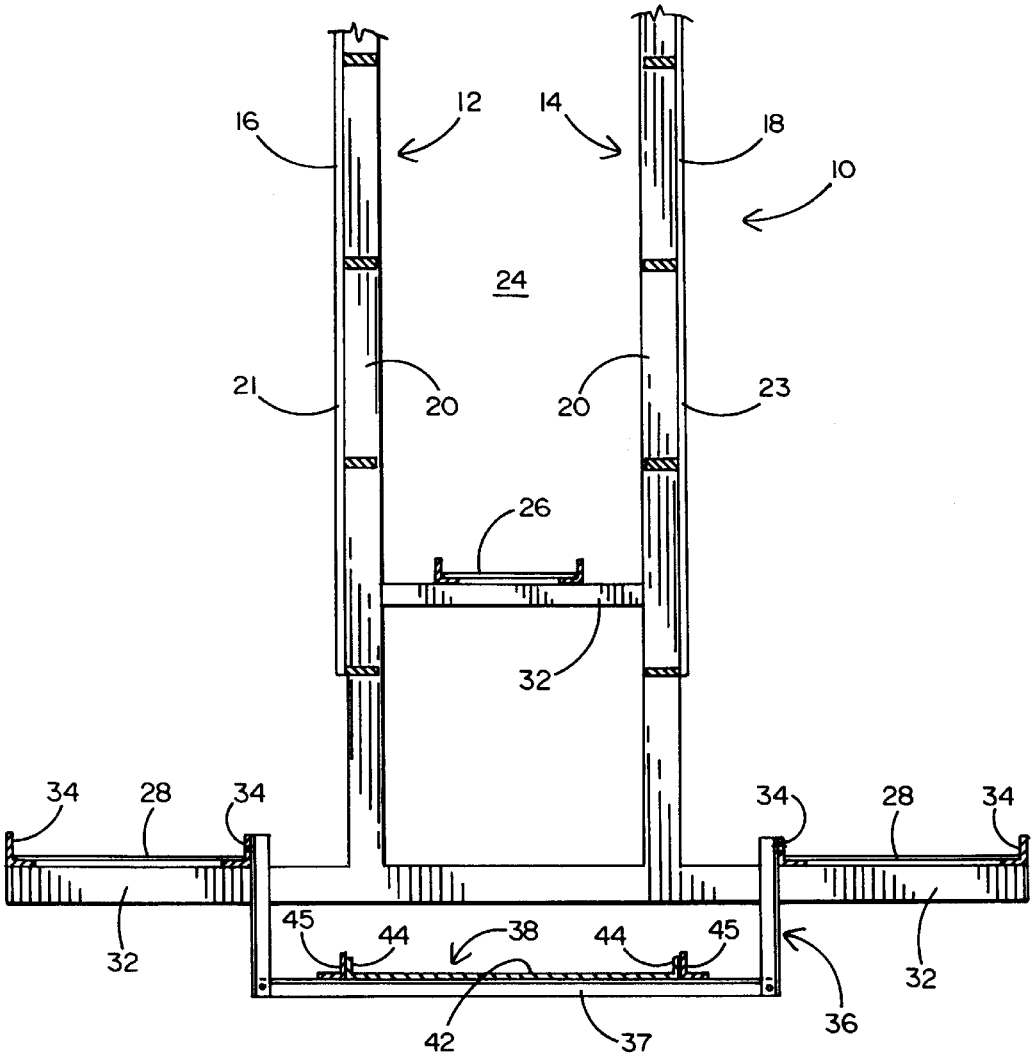
FIG. 4 is a detail vertical section of the bottom part of the billboard of FIG. 1, in a plan perpendicular to the billboard.

The decks 26 and 28 are conventionally supported by a framework consisting of longitudinally spaced support bars 32 attached to the grids 20, and longitudinally extending deck retaining flanges 34 which are attached to the support bars 32, and which may also carry floodlights 35. In accordance with the invention, U-shaped tray supports 36 are suspended at intervals from the flanges 34. The tray supports 36 support a tray 38 extending longitudinally of the billboard 10. In a preferred embodiment of the invention, the center section 37 of the tray supports 36 is slightly below the level of deck 28 near the outer lateral end of the billboard, and is lower and lower in each successive tray support 36 toward the column 22 (FIG. 3). Consequently, the tray 38 resting on the tray supports 36 is inclined in a longitudinal direction toward the column 22. This causes rain water (or, if desired, piped water where there is insufficient rain) to wash the tray 38 as it drains toward and into a downspout 40 that is preferably attached to the column 22.

The tray 38 is preferably formed of a durable, liquid-impervious material such as galvanized steel. It has a substantially flat bottom surface 42 (FIG. 4) that preferably extends longitudinally throughout substantially the entire length of the billboard, and transversely through the entire distance between the grids 20. Vertical flanges 44 are sealingly attached around the bottom surface 42 to channel water along the tray 38 and prevent it from dripping over the edges of tray 38. The flanges 44 are preferably secured to longitudinally extending brackets 45 which are in turn secured to the tray supports 36. In addition to their water-channeling action, the flanges 44 are also useful in preventing wind from blowing debris off the bottom surface 44. The optimum height of the flanges 44 on a typical billboard is about 7.5 cm.

In FIGS. 1–4, the column 22 has been depicted as being at one longitudinal end of the billboard 10. It will be understood that if the column 22 is in the center of the billoard 10, the billboard 10 can be considered as a pair of mutually mirror-image structures, of the type described above in connection with FIGS. 1–4, that are joined at the column 22 and extend in opposite directions away from it.

Figure 5:
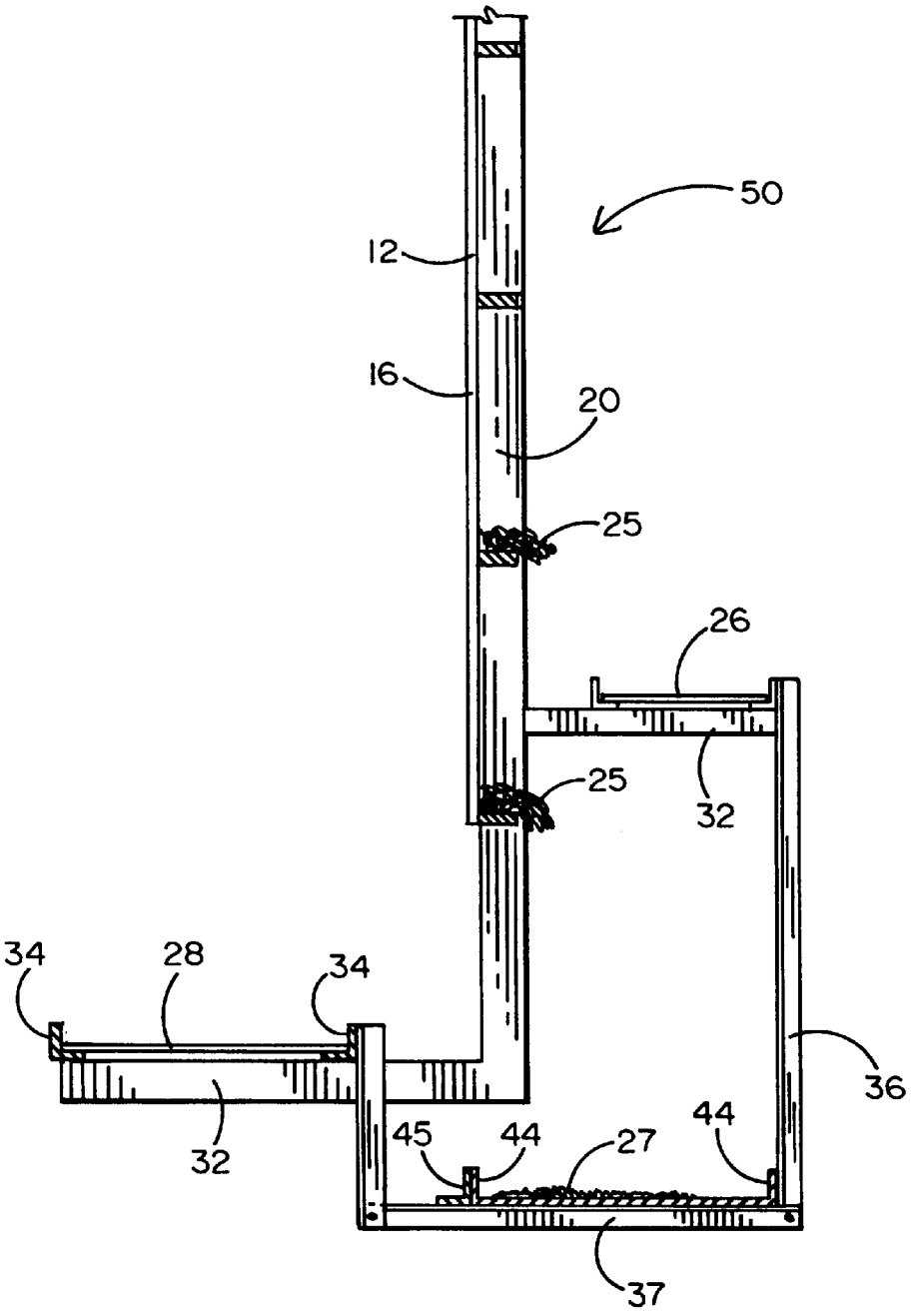
FIG. 5 is a detail vertical section of the bottom part of an alternative embodiment of the billboard.

FIG. 5 illustrates the invention in connection with a single-sided billboard 50. In such a billboard, the tray 38 preferably extends from the grid 20 to at least the outer edge of the rear deck 26. It is otherwise supported and constructed in the same way as the tray of FIGS. 1–4.

It should be understood that the exemplary billboards with droppings trays described herein and shown in the drawings represent only presently preferred embodiments of the invention. Indeed, various modifications and additions may be made to such embodiments without departing from the spirit and scope of the invention. Thus, other modifications and additions may be obvious to those skilled in the art and may be implemented to adapt the present invention for use in a variety of different applications.

What is claimed is:

1. A billboard comprising:

a) a vertically extending display panel assembly having a sign face and a rear face forming an open gridwork suitable for the nesting of birds; and b) a substantially horizontal tray extending in a substantially horizontal plane at least rearwardly from said rear face a sufficient distance to catch droppings from birds nesting in said open gridwork on said rear face.

2. The billboard of claim 1, in which said panel assembly is supported by a column and extends longitudinally horizontally outwardly from said column toward a longitudinally horizontally outer end of said panel assembly, and said tray extends longitudinally along substantially the entire length of said panel assembly from said column to said longitudinally outer end of said panel assembly.

3. The billboard of claim 1, in which said tray includes a water outlet, and said tray is inclined from the horizontal in such a way as to cause water in said tray to drain into said water outlet.

4. The billboard of claim 1, further including at least one apertured horizontal deck extending in a substantially horizontal plane in a direction parallel to said panel assembly below its lower edge and spaced therefrom vertically and horizontally, the plane of said tray being below the plane of said deck.

5. The billboard of claim 1, in which said billboard includes a pair of spaced display panel assemblies whose sign faces face in opposite directions, and said tray extends at least substantially throughout the entire distance of the space between said panel assemblies.

6. The billboard of claim 1, in which said billboard includes an apertured deck extending longitudinally along the rear face of said panel assembly and rearwardly spaced therefrom, and said tray extends substantially under all of said deck.

7. The billboard of claim 1, in which said tray has a watertight horizontal bottom surrounded by watertight vertically upwardly extending flanges sealed thereto, said flanges being about 7.5 cm in height.

8. In combination with a billboard having a vertically extending display panel attached to a face of an elongated grid of support members dimensioned to provide nesting sites for birds, a liquid-impervious tray extending below said grid longitudinally of said grid, and extending transversely from said grid in a direction rearwardly of said display panel, said billboard having a pair of parallel horizontally spaced display panels facing in opposite directions, each of said panels being mounted on one of a pair of spaced support member grids, and said tray extending transversely substantially throughout the space between said grids.

9. In combination with a billboard having a vertically extending display panel attached to a face of an elongated grid of support members dimensioned to provide nesting sites for birds, a liquid-impervious tray extending below said grid longitudinally of said grid, and extending transversely from said grid in a direction rearwardly of said display panel, said tray being inclined so as to drain water toward one point thereon, a drain being provided at that point to drain water from said tray.

* * * * *